US007523828B2

(12) United States Patent
Dewolf et al.

(10) Patent No.: US 7,523,828 B2
(45) Date of Patent: Apr. 28, 2009

(54) PORTABLE CADDY

(76) Inventors: Mark Dewolf, 3940 Blue Hill, Detroit, MI (US) 48224; Michael Tomaszewski, 22813 Amherst, St. Clair Shores, MI (US) 48081

( * ) Notice: Subject to any disclaimer, the term of this patent is extended or adjusted under 35 U.S.C. 154(b) by 0 days.

(21) Appl. No.: 11/971,141

(22) Filed: Jan. 8, 2008

(65) Prior Publication Data

US 2008/0163591 A1 Jul. 10, 2008

Related U.S. Application Data

(60) Provisional application No. 60/883,978, filed on Jan. 8, 2007.

(51) Int. Cl.
*B65D 1/34* (2006.01)
*A45C 11/20* (2006.01)

(52) U.S. Cl. ..... 206/541; 206/225; 206/553; 206/564; 53/474; 220/756

(58) Field of Classification Search ..... 206/225, 206/233, 389, 397, 408, 449, 541, 553, 549, 206/561, 564, 565; D3/308, 315; 53/461, 53/474; 220/756, 759, 761, 768, 770; 248/317, 248/318, 346.01
See application file for complete search history.

(56) References Cited

U.S. PATENT DOCUMENTS

| | | | | |
|---|---|---|---|---|
| 3,135,392 | A | | 6/1964 | Elkins |
| 3,258,017 | A | | 6/1966 | Albert |
| D212,315 | S | | 9/1968 | Taylor |
| D213,602 | S | | 3/1969 | Taylor |
| D218,722 | S | | 9/1970 | Vaccaro |
| 3,754,804 | A | | 8/1973 | Cushman |
| 3,907,105 | A | | 9/1975 | Nowak |
| D252,479 | S | * | 7/1979 | Goeden ..... D3/308 |
| 4,480,810 | A | | 11/1984 | Hall |
| 4,541,539 | A | | 9/1985 | Matthews |
| D284,235 | S | | 6/1986 | Zinter-Chahin |
| D301,667 | S | | 6/1989 | Barrs et al. |
| D310,749 | S | | 9/1990 | Ancona et al. |
| D314,658 | S | | 2/1991 | Ancona et al. |
| 5,035,321 | A | | 7/1991 | Denton |
| D320,687 | S | | 10/1991 | Perry |
| D326,347 | S | | 5/1992 | Ancona et al. |
| D330,658 | S | | 11/1992 | Manning |
| D334,094 | S | | 3/1993 | Braid |
| 5,370,263 | A | | 12/1994 | Brown |
| D369,523 | S | | 5/1996 | Olson |
| D382,711 | S | | 8/1997 | Wyman |
| 5,890,589 | A | * | 4/1999 | Lorens ..... 206/564 |
| 5,961,191 | A | | 10/1999 | Taylor |

(Continued)

*Primary Examiner*—Luan K Bui
(74) *Attorney, Agent, or Firm*—Cantor Colburn LLP

(57) ABSTRACT

A portable caddy, comprising: a base portion; a handle portion removably secured to an upper surface of the base portion, the handle portion having a pair of support members and an elongated member extending therebetween, the handle portion being configured to rotatably support a roll of paper towels above the upper surface of the base portion; a plurality of recessed areas disposed in the upper surface; and an opening in a side wall of the base portion, the opening providing access to a receiving area disposed between the upper surface and a bottom surface of the base portion, wherein the receiving area is configured to store a plurality of plates therein and wherein the opening allows removal of the plates from the receiving area.

24 Claims, 3 Drawing Sheets

U.S. PATENT DOCUMENTS 6,006,502 A * 12/1999 Smith ..... 53/461
6,267,316 B1 7/2001 Cross
6,375,115 B1 4/2002 Reed
6,425,647 B1 7/2002 Pothin
6,460,697 B1 10/2002 Stevens
6,745,895 B2 * 6/2004 Silvers ..... 206/233
7,013,671 B1 * 3/2006 Bolda ..... 206/541

* cited by examiner

PORTABLE CADDY

CROSS REFERENCE TO RELATED APPLICATIONS

This application claims the benefit of U.S. Provisional Patent Application Ser. No. 60/883,978 filed Jan. 8, 2007, the contents of which are incorporated herein by reference thereto.

BACKGROUND

The present invention relates generally to an apparatus and method for conveniently providing and dispensing paper products, and more particularly to a portably caddy for holding and dispensing such paper products.

Disposable plates, napkins and utensils have made the preparation of meals, picnics, camping events, barbeques, etc. easier to prepare for and clean up after as the plates, napkins and utensils may simply be thrown out after use. However and for events away from the comforts of home there is still the need to carry all of the required staples to the event. In addition, there is still a need for an efficient way to dispense the required staples for use at the event.

Accordingly, it is desirable to provide an apparatus and method for providing napkins and other items.

SUMMARY OF THE INVENTION

According to an exemplary embodiment of the present invention, a portable caddy is provided, the portable caddy comprising: a base portion; a handle portion removably secured to an upper surface of the base portion, the handle portion having a pair of support members and an elongated member extending therebetween, the handle portion being configured to rotatably support a roll of paper towels above the upper surface of the base portion; a plurality of recessed areas disposed in the upper surface; and an opening in a side wall of the base portion, the opening providing access to a receiving area disposed between the upper surface and a bottom surface of the base portion, wherein the receiving area is configured to store a plurality of plates therein and wherein the opening allows removal of the plates from the receiving area.

In another exemplary embodiment the portable caddy comprises: base portion; handle portion secured to the base portion; a paper towel dispenser removably secured to an upper surface of the base portion, the paper towel dispenser having a pair of support members and an elongated member extending therebetween, the paper towel dispenser being configured to rotatably support a roll of paper towels above the upper surface of the base portion; a plurality of recessed areas disposed in the upper surface; and an opening in a side wall of the base portion, the opening providing access to a receiving area disposed between the upper surface and a bottom surface of the base portion, wherein the receiving area is configured to store a plurality of plates therein and wherein the opening allows removal of the plates from the receiving area.

In another exemplary embodiment a method for portably providing articles for use with food products is provided, the method comprising: providing a portable caddy, the portable caddy, comprising: a base portion; a handle portion removably secured to an upper surface of the base portion, the handle portion having a pair of support members and an elongated member extending therebetween, the handle portion being configured to rotatably support a roll of paper towels above the upper surface of the base portion; a plurality of recessed areas disposed in the upper surface; and an opening in a side wall of the base portion, the opening providing access to a receiving area disposed between the upper surface and a bottom surface of the base portion, wherein the receiving area is configured to store a plurality of plates therein and wherein the opening allows removal of the plates from the receiving area; dispensing paper towels from the roll of paper towels; storing a plurality of plates within the receiving area; and dispensing the plurality of plates from the receiving area.

BRIEF DESCRIPTION OF THE DRAWINGS

The present invention will now be described, by way of example only, with reference to the accompanying drawings in which.

The above-described and other features and advantages of the present application will be appreciated and understood by those skilled in the art from the following detailed description, drawings, and appended claims.

DETAILED DESCRIPTION OF EXEMPLARY EMBODIMENTS

In accordance with exemplary embodiments of the present invention an apparatus and method for dispensing products is provided.

Figure 1:
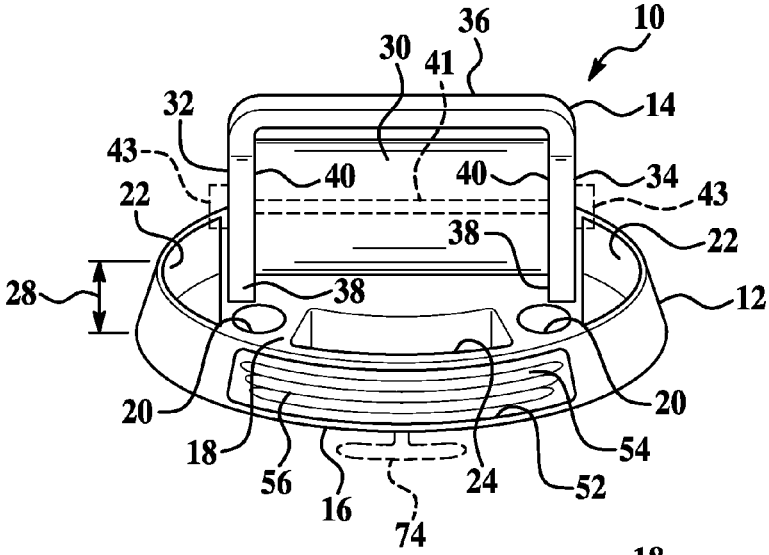
FIG. 1 is a perspective view of an exemplary embodiment of the present invention.
Figure 2:
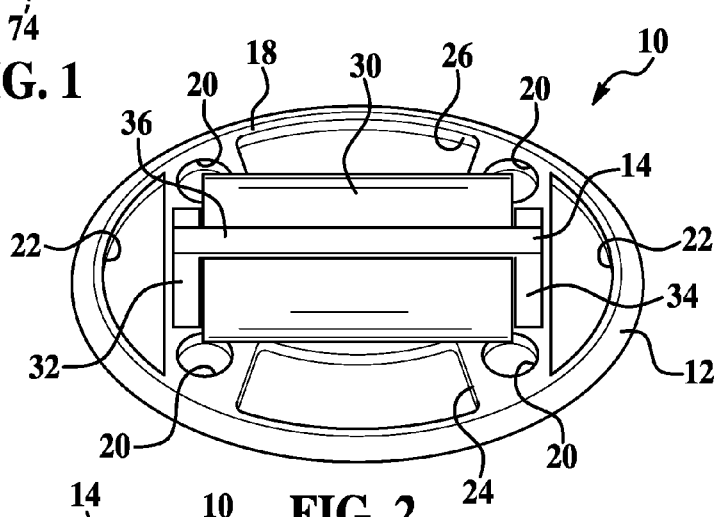
FIG. 2 is a top plan view of the embodiment illustrated in FIG. 1.
Figure 3:
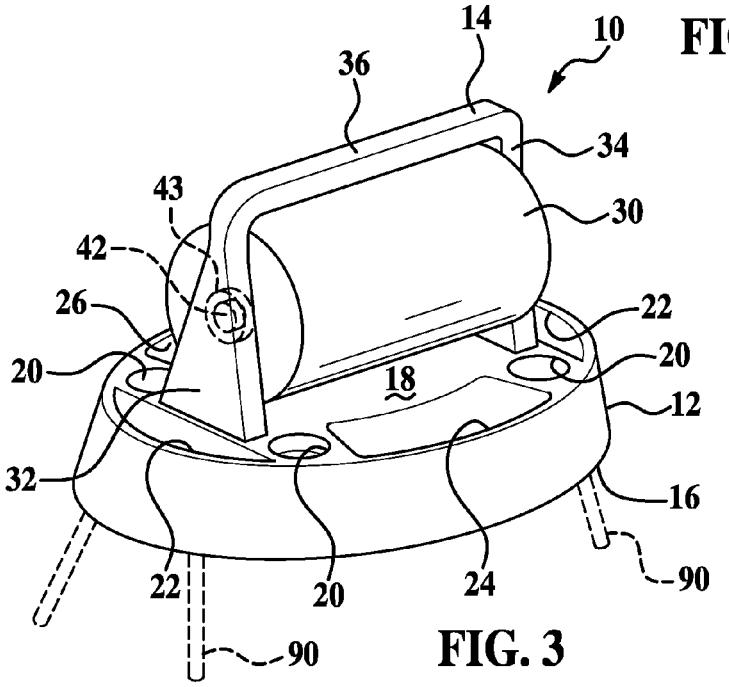
FIG. 3 is a perspective view of an exemplary embodiment of the present invention.

Referring now to FIGS. 1-3 and in accordance with an exemplary embodiment, a portable caddy or carrier 10 comprising a paper towel dispensing unit 11 is illustrated. In accordance with an exemplary embodiment carrier 10 is configured to receive a roll of paper towels or other paper equivalent materials 13 and a plurality of other items wherein the same is easily transported to a remote location such as a picnic area. Carrier 10 is further configured to permit a portion of or the entire roll of paper towels or any of the items to be selectively and easily removed from the carrier.

Carrier 10 includes a base member 12 and a handle 14 secured thereto. In one exemplary embodiment handle 14 is removably secured to the base member. In one non-limiting exemplary embodiment, the handle is "snap fittingly" engaged with the base. In another alternative exemplary embodiment, the handle is permanently molded with the base member. In accordance with an exemplary embodiment carrier 10 is constructed out of an easily molded material such as plastic, which in one exemplary embodiment is formed by an injection molding process.

In an exemplary embodiment, base member 12 includes a lower surface 16, an upper surface 18, and a plurality of shaped recessed areas 20, 22, 24 and 26 disposed in base member 12. Lower surface 16 is generally parallel to and spaced apart from upper surface 18 defining a thickness 28 of base member 12. Alternatively, the upper surface 18 has no recessed areas.

Base member 12 is not intended to be limited to the shape illustrated in FIGS. 1-3, but can have any geometric shape, non-geometric shape or a combination thereof. Each of the plurality of recessed areas is spaced apart from an adjacent recessed area and extends into the base member from upper surface 18 in a direction toward lower surface 16 within the thickness of the base member. Each of the plurality of recessed areas is provided for receiving an item therein.

For example and in one embodiment, recessed area 20 is configured to receive a periphery of a can of soda, a bottle of ketchup, or the like. In another embodiment, recessed areas 22 and 24 are configured to receive salt and pepper dispensers. In another alternative exemplary embodiment, base member can include a recessed area configured to receive a plurality of toothpicks, or silverware, etc. Additionally and in another exemplary embodiment, any of the recessed areas can be configured to snugly receive the item intended to be received therein. For example, it may be desired to have a recessed area that snugly holds a container of material to reduce a chance of the container spilling its material from the container.

In yet another alternative configuration, the carrier may have any number and configuration of recessed areas for receiving items therein.

Handle 14 is provided to allow carrier 10 to be moved to another location by grasping a portion of the handle to move the carrier. Handle 14 is further configured to rotatably hold a roll of paper towels 30 so that the roll of paper towels will rotate between the handle and the upper surface of the base member. In an exemplary embodiment, handle 14 is a substantially channel shaped member secured to upper surface 18 of the base member. Handle 14 includes legs or support members 32, 34 and a bar member 36. Each of legs 32, 34 has a length extending from a first end 38 to a second end 40 so that the roll of paper towels will rotate between bar member 36 and upper surface 18 of the base member when the roll of paper towels is held within handle 14. Legs 32 and 34 are spaced apart so that the roll of paper towels will rotate between legs 32 and 34 when the roll of paper towels is held within handle 14. First end 38 of each of the legs is secured to upper surface 18 of the base member. Second end 40 of each of the legs is secured to an end of bar member 36 positioning bar member 36 above upper surface 18 of the base member. Each of legs 32 and 34 further include an indentation 42 configured to receive an end portion of a rod member about which the roll of paper towels is wrapped.

In accordance with an exemplary embodiment the support members or legs are integrally molded with the base member and comprise a resilient material allowing for the removal and insertion of the rod member therein to allow for replacement of the roll of paper towels. In yet another alternative exemplary embodiment, the rod member is a spring loaded dowel member that allows for removal and insertion of the paper towels therein.

In yet another alternative, a dowel member 41 passes through openings in the handle and the paper towel roll and decorative knob members 43 are secured to either end. The decorative knob members being larger than the openings in the handle the dowel travels through, and the decorative knob members are releasably engaged to the dowel (e.g., threads on the dowel and an inner opening of the decorative member or equivalents thereof, one non-limiting example would be a "snap fit" or course, other removable securement features are contemplated). Accordingly, the removable decorative knob members allow a new roll of paper products to be secured to the handle portion as well as providing a means for various decorative knobs to be placed on the assembly (e.g., a single caddy can have various configurations or color schemes through the use of knob 43). For example, knobs resembling a favorite sports team can be placed on the ends of the dowel. These knobs could be purchased separately and allow for the assembly to change appearance to coincide with a specific event (e.g., football game, baseball game, basketball game, hockey game, etc. that the portable carrier or caddy is being used at). Moreover, the knobs can resemble items such as football helmets, footballs, baseballs, baseball caps, hockey pucks, basketballs and/or the favorite team colors in order to provide a customizable assembly.

In accordance with one alternative exemplary embodiment, at least one of the support members is removably secured to the upper surface by a resilient feature 44 that snap fittingly engages an aperture 46 in the upper surface.

In accordance with an exemplary embodiment, a side wall 50 of the base member is configured to have an opening 52 disposed therein, the opening providing access to a receiving area 54 disposed between the upper surface and the bottom surface of the base portion. In accordance with an exemplary embodiment the receiving area is configured to store a plurality of plates 56 therein, wherein the opening allows removal of the plates from the receiving area. Non-limiting examples of the types of plates include disposable and reusable plates including but not limited to paper, plastic, styrofoam, etc. One non-limiting configuration of the portable caddy contemplates the base portion having a circular configuration, wherein the diameter of the base portion is less than 18 inches or in other words the base portion is slightly larger than the diameter of the plate stored therein.

In accordance with an exemplary embodiment of the present invention and as illustrated, the thickness 28 of the base portion and the location of the recessed areas in the top surface are arranged such that receiving area 54 is large enough to receive the plates therein while the size of the cavity or recessed area is not affected by the location of the openings in the upper surface. In other words, the thickness 28 may be larger than illustrated in the attached drawings in order to ensure area 54 is large enough for the plates and openings 20, 22, 24 and 26 are deep enough. Alternatively, openings 20, 22, 24 and 26 are not used or disposed outside the periphery of area 54 thus, the outer periphery of the base is larger. In yet another embodiment and as mentioned above thickness 28 is large enough to accommodate the depth of openings 20, 22, 24 and 26 and the height of area 54.

In one exemplary embodiment, the plurality of plates are disposable plates made from biodegradable materials. In another alternative exemplary embodiment, the portable caddy further comprises a door pivotally, slidably or removably secured to the opening in the side wall. In one non-limiting exemplary embodiment, a slidable door 80 is shown in opening 52, the slidable door being received within a cavity of the base portion as the door slides open to provide access to an inner cavity of the base portion. Alternatively, door 80 is pivotally secured to the base member or can be configured to snap fit or frictionally engage opening 52 and then the door is simply "popped" out of opening 52.

In another exemplary embodiment, the portable caddy is sold as a single unit having the plates, utensils (knives and forks), paper towels and condiments stored therein and the consumer simply purchases the unit and is ready for their event.

Accordingly, the portably caddy allows paper towels or paper products and plates (paper or otherwise) to be stored and easily transported to a picnic, boat, car or any outdoor event.

Figure 4:
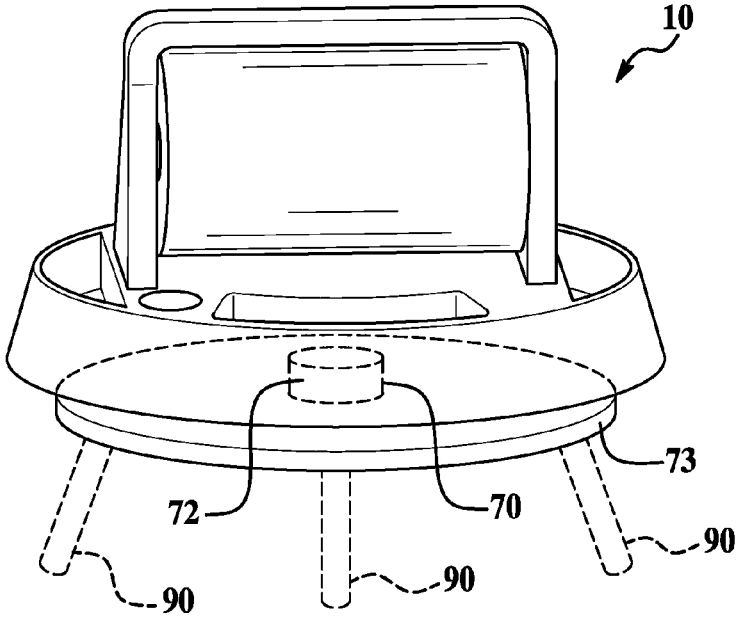
FIG. 4 is a perspective view of an alternative exemplary embodiment of the present invention.
Figure 5:
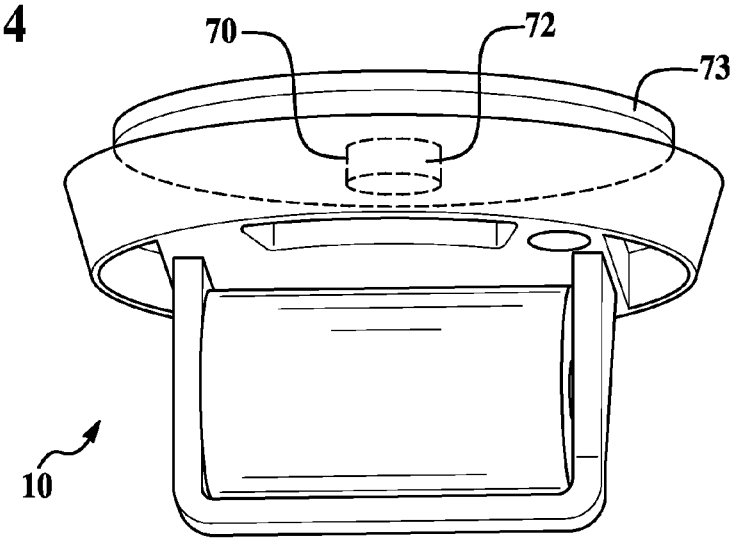
FIG. 5 is a perspective view of another alternative exemplary embodiment of the present invention.

In accordance with an alternative exemplary embodiment and referring now to FIGS. 4-5, the portably caddy further comprises a mounting aperture 70 disposed in the lower surface of the base portion. In this embodiment, the mounting aperture is configured to releasably engage a mounting feature 72 securable to a mounting surface 73.

In one non-limiting exemplary embodiment, the mounting feature is a hook member configured to be secured to a wall surface and the hook member mounts the portable caddy to the wall for use, for example in a house, car, RV, boat ect. and then the caddy is easily removed for remote usage and then returned for a more permanent place of storage and usage. For example, FIG. 5 shows the portable caddy releasably mounted upside down on for example, a bottom surface of a cabinet.

In another alternative exemplary embodiment, the mounting feature is a suction cup 74 (illustrated by the dashed lines in FIG. 1). In yet another alternative a plurality of suction cups may be employed. In another alternative exemplary embodiment and referring now to FIGS. 6 and 7, the mounting feature comprises a rotatable base portion 76 securable to the lower surface, wherein the rotatable base portion allows the caddy to be rotated similar to a "Lazy Susan".

Figure 7:
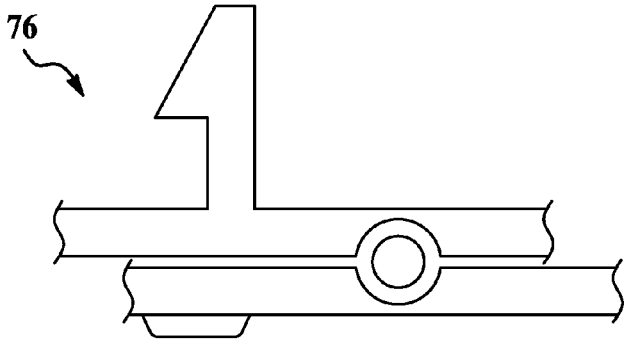
FIG. 7 is a partial view of another alternative exemplary embodiment of the present invention.
Figure 8:
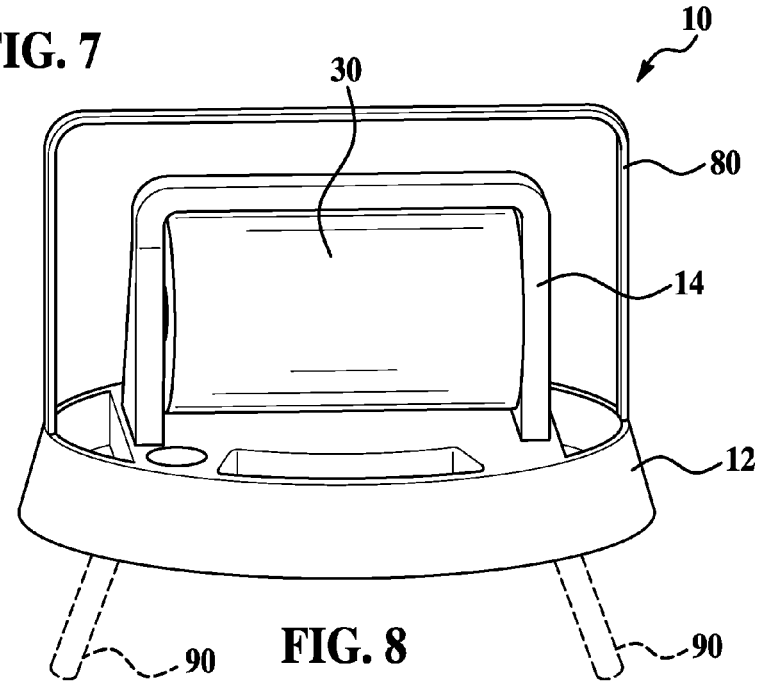
FIG. 8 is a perspective view of another alternative exemplary embodiment of the present invention.
Figure 9:
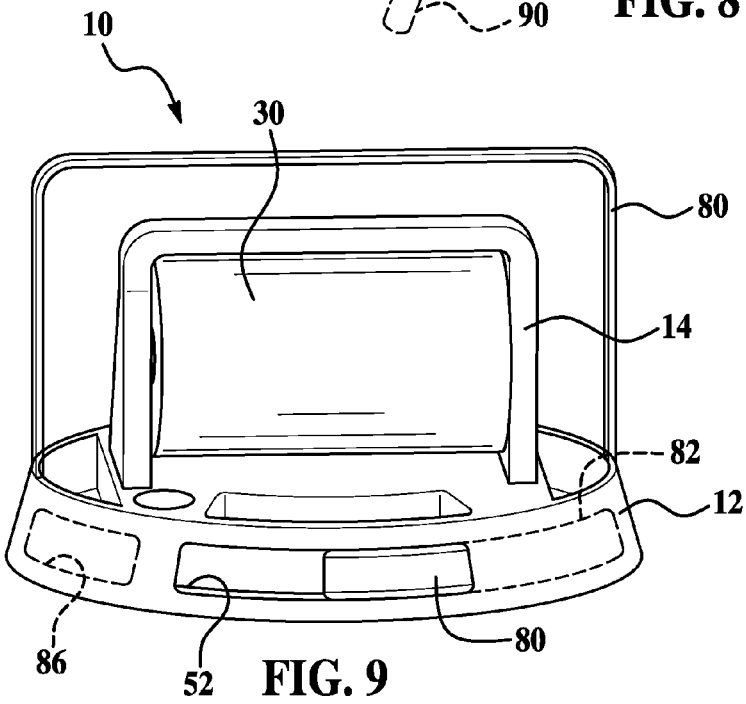
FIG. 9 is a perspective view of another alternative exemplary embodiment of the present invention.

In yet another alternative exemplary embodiment and referring now to FIG. 7, the portable caddy further comprises a handle portion 80 that is disposed above handle 14. In this embodiment, handle 14 is mainly used to secure the paper towels and handle portion 80 is used to transport the caddy from location to location.

In yet another alternative exemplary embodiment, the carrier has a plurality of removable leg portions 90 that are removably secured to anyone of the bottom base portion 12, member 73, rotatable base portion 76 or any other portion of carrier 10 that would convert the same into a portable carrier with leg portions to have it be configured as a stand alone items. In accordance with an exemplary embodiment of the present invention the leg portions can be extendable/collapsible members (e.g., telescoping) to vary the height of the carrier. In one embodiment and when not in use, the leg portions are stowed and/or received in openings in the bottom portion of the base. Thereafter and when the use of leg portions 90 is desired the leg portions are removed and inserted into openings in the base portion and the base portion of the carrier is now capable of standing away from a surface. In one exemplary embodiment, the base member of the carrier can act as a table if the legs are long enough and the base portion is wide enough. Here the base portion serves as a table for dispensing condiments, paper plates and paper towels.

In yet another alternative exemplary embodiment a face surface of the base portion has a recessed area 86 or a plurality of recessed areas 86 for receipt of decorative indicia or stickers therein. Again, this would allow a user to customize their carrier for particular events by purchasing stickers preconfigured to be received with recessed area 86. Once again, these stickers may be sports related or may simply comprise colors to augment colors of the portable carrier.

Figure 6:
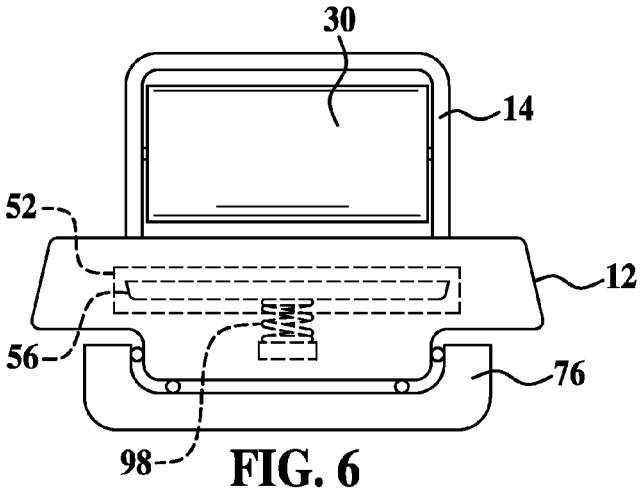
FIG. 6 is a side view of another alternative exemplary embodiment of the present invention.

In still another alternative exemplary embodiment of the present invention, and referring to FIG. 6, a spring or biasing member 98 is positioned in the inner cavity of the base portion housing the plates 56 and the biasing member pushes the plates against a surface or protruding surface of the inner cavity or receiving area to prevent the paper plates from sliding out of opening 52 should carrier 10 be tilted on its side and not have a door member or the door member is open.

In accordance with an exemplary embodiment of the present invention the plates 56 are still accessible through opening 52 via door 80 or in an embodiment without door 80 wherein a user simply grips an edge of a plate 56 overcomes the frictional biasing force of spring 98 and slides the plate out through opening 52.

In accordance with an exemplary embodiment, the portable caddy is formed via an injection molding process using any number of suitable materials. In one exemplary embodiment, the portable caddy is formed from thermoplastic materials. Preferred materials are those materials that have the desired characteristics of strength, durability, flexibility, and finished appearance and feel for use as the portable caddy.

In another alternative exemplary embodiment, portions of the portable caddy (e.g., handle portion, paper towel portion, etc.) may be formed from other materials and/or colors to provide structural and aesthetically pleasing appearances, In yet another exemplary embodiment, the portable caddy may be manufactured with color schemes to match a favorite sports team or any other color combination.

It being understood that any of the aforementioned features may be combined in numerous combinations and that the specific configurations illustrated are provided as exemplary examples and embodiments of the present invention are not intended to be limited to the specific configuration illustrated.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A portable caddy, comprising:

a base portion;

a handle portion removably secured to an upper surface of the base portion, the handle portion having a pair of support members and an elongated member extending therebetween, the handle portion being configured to rotatably support a roll of paper towels above the upper surface of the base portion;

a plurality of recessed areas disposed in the upper surface; and an opening in a side wall of the base portion, the opening providing access to a receiving area disposed between the upper surface and a bottom surface of the base portion, wherein the receiving area is configured to store a plurality of plates therein and wherein the opening allows removal of the plates from the receiving area.

2. The portable caddy as in claim 1, wherein the base portion is circular in configuration and the diameter of the base portion is less than 18 inches.

3. The portable caddy as in claim 1, wherein the plurality of plates are disposable plates made from biodegradable materials and the receiving area further comprises a spring member for biasing the plurality of plates against a surface of the receiving area.

4. The portable caddy as in claim 1, wherein at least one of the pair of support members is removably secured to the upper surface by a resilient feature that snap fittingly engages an aperture in the upper surface.

5. The portable caddy as in claim 4, wherein the elongated member is releasably secured to at least one of the pair of support members.

6. The portable caddy as in claim 1, further comprising a mounting aperture disposed in a lower surface of the base portion, wherein the aperture is configured to releasably engage a mounting feature securable to a mounting surface.

7. The portable caddy as in claim 1, further comprising a mounting aperture disposed in a lower surface of the base portion, wherein the aperture is configured to releasably and rotatably engage a mounting feature securable to a mounting surface.

8. The portable caddy as in claim 1, further comprising a mounting aperture disposed in a lower surface of the base portion, wherein the aperture is configured to releasably engage a mounting feature securable to a mounting surface.

9. The portable caddy as in claim 1, further comprising a door slidably secured to the opening in the side wall.

10. The portable caddy as in claim 1, wherein the plurality of recessed areas are configured and dimensioned to received forks and knives therein and wherein a plurality of leg portions are removably secured to the bottom surface of the base portion.

11. The portable caddy as in claim 1, further comprising a gripping member secured to a lower surface of the base portion.

12. The portable caddy as in claim 11, wherein the gripping member is a suction cup.

13. A portable caddy, comprising:

a base portion;

a handle portion secured to the base portion;

a paper towel dispenser removably secured to an upper surface of the base portion, the paper towel dispenser having a pair of support members and an elongated member extending therebetween, the paper towel dispenser being configured to rotatably support a roll of paper towels above the upper surface of the base portion;

a plurality of recessed areas disposed in the upper surface; and an opening in a side wall of the base portion, the opening providing access to a receiving area disposed between the upper surface and a bottom surface of the base portion, wherein the receiving area is configured to store a plurality of plates therein and wherein the opening allows removal of the plates from the receiving area.

14. The portable caddy as in claim 13, wherein the plurality of plates are disposable plates made from biodegradable materials.

15. The portable caddy as in claim 13, wherein at least one of the pair of support members is removably secured to the upper surface by a resilient feature that snap fittingly engages an aperture in the upper surface and wherein the elongated member is releasably secured to at least one of the pair of support members.

16. The portable caddy as in claim 13, further comprising a mounting aperture disposed in a lower surface of the base portion, wherein the aperture is configured to releasably engage a mounting feature securable to a mounting surface.

17. The portable caddy as in claim 13, further comprising a mounting aperture disposed in a lower surface of the base portion, wherein the aperture is configured to releasably and rotatably engage a mounting feature securable to a mounting surface.

18. The portable caddy as in claim 13, further comprising a door pivotally secured to the opening in the side wall and wherein the plurality of recessed areas are configured and dimensioned to received forks and knives therein.

19. A method for portably providing articles for use with food products, the method comprising:

providing a portable caddy, the portable caddy, comprising: a base portion; a handle portion removably secured to an upper surface of the base portion, the handle portion having a pair of support members and an elongated member extending therebetween, the handle portion being configured to rotatably support a roll of paper towels above the upper surface of the base portion; a plurality of recessed areas disposed in the upper surface; and an opening in a side wall of the base portion, the opening providing access to a receiving area disposed between the upper surface and a bottom surface of the base portion, wherein the receiving area is configured to store a plurality of plates therein and wherein the opening allows removal of the plates from the receiving area;

dispensing paper towels from the roll of paper towels;

storing a plurality of plates within the receiving area; and dispensing the plurality of plates from the receiving area.

20. The method as in claim 19, wherein the plurality of plates are disposable plates made from biodegradable materials.

21. The method as in claim 19, wherein at least one of the pair of support members is removably secured to the upper surface by a resilient feature that snap fittingly engages an aperture in the upper surface and wherein the elongated member is releasably secured to at least one of the pair of support members.

22. The method as in claim 19, further comprising a mounting aperture disposed in a lower surface of the base portion, wherein the aperture is configured to releasably engage a mounting feature securable to a mounting surface.

23. The method as in claim 19, further comprising a mounting aperture disposed in a lower surface of the base portion, wherein the aperture is configured to releasably and rotatably engage a mounting feature securable to a mounting surface.

24. The method as in claim 19, further comprising a door pivotally secured to the opening in the side wall and wherein the plurality of recessed areas are configured and dimensioned to received forks and knives therein.

* * * * *